United States Patent [19]

van de Plassche et al.

[11] 4,446,419

[45] May 1, 1984

[54] CURRENT STABILIZING ARRANGEMENT

[75] Inventors: Rudy J. van de Plassche; Eise C. Dijkmans; Hendrikus J. Schouwenaars, all of Eindhoven, Netherlands

[73] Assignee: U.S. Philips Corporation, New York, N.Y.

[21] Appl. No.: 399,170

[22] Filed: Jul. 19, 1982

[30] Foreign Application Priority Data

Aug. 14, 1981 [NL] Netherlands ..... 8103813

[51] Int. Cl.[3] ..... G05F 3/20

[52] U.S. Cl. ..... 323/316; 323/907; 307/297; 330/257

[58] Field of Search ..... 323/312, 313, 314, 315, 323/316, 907; 307/296 R, 297, 310; 330/256, 257, 288, 289, 297, 252

[56] References Cited

U.S. PATENT DOCUMENTS

| | | | |
|---|---|---|---|
| 3,914,683 | 10/1975 | van de Plassche | 323/316 |
| 4,100,436 | 7/1978 | van de Plassche | 323/315 X |
| 4,263,519 | 4/1981 | Schade, Jr. | 323/314 X |
| 4,300,091 | 11/1981 | Schade, Jr. | 307/297 X |

OTHER PUBLICATIONS

G. Keller et al., "Current Source Generator", IBM Technical Disclosure Bulletin, vol. 12, No. 11, Apr. 1970, p. 2031.

*Primary Examiner*—Peter S. Wong

*Attorney, Agent, or Firm*—Robert T. Mayer; Bernard Franzblau

[57] ABSTRACT

In a known current source arrangement which generates a current whose temperature coefficient is only equal to zero at one specific temperature, steps are taken, in accordance with the invention, to render the generated current independent of the temperature over a wide temperature range by compensation of the disturbing factor in the relationship between the generated current and the temperature.

3 Claims, 3 Drawing Figures

CURRENT STABILIZING ARRANGEMENT

The invention relates to a current stabilizing arrangement comprising a first and a second series circuit, which are each connected between a first and a second junction point, which first series circuit comprises the main current path of a first transistor of a first conductivity type, a first resistor and a second resistor, and which second series circuit comprises the main current path of a second transistor of the first conductivity type, having an emitter area which is smaller than that of the first transistor, and a third resistor, suitably having a value equal to that of the second resistor, which first resistor is arranged between the emitter of the first transistor and the first junction point, which second resistor is arranged between the collector of the first transistor and the second junction point, and which third resistor is arranged between the collector of the second transistor and the second junction point, the base connections of the first and the second transistor being connected to a third junction point, a fourth resistor being arranged between the third junction point and the first junction point, there being provided a differential amplifier having an inverting input, a non-inverting input and an output, which inverting input is connected to that terminal of the second resistor which is remote from the second junction point, which non-inverting input is connected to that terminal of the third resistor which is remote from the second junction point, and which output is coupled to the third junction point, the current stabilizing arrangement comprising means for applying a power-supply voltage thereto for maintaining a potential difference between the first and the second junction point and for taking off a stabilized current from one of said points.

Such a current stabilizing arrangement is known from Philips Technical Review Vol. 38, 1978/79 No. 7/8, pp. 188–189. The current stabilizing arrangement of the type mentioned in the opening paragraph comprises means to compensate for the temperature dependence of the current generated by the stabilizing arrangement. Said means comprise said fourth resistor, which adds a component whose temperature coefficient is opposite to that of the noncompensated current to the generated current. By means of this compensation it is possible to generate a current whose temperature coefficient is zero at a specific temperature, but for other temperatures deviations will occur. In general, the temperature coefficient exhibits a substantially parabolic variation around said temperature. For specific uses where a better temperature independence is required, such as in accurate measuring equipment or AD converters, it is necessary that the temperature coefficient remains equal to zero over a wider temperature range. It is an object of the invention to provide a solution for this. To this end the current stabilizing arrangement according to the invention is characterized in that between the emitter of the first transistor and the first junction point there is arranged at least one third transistor of the first conductivity type, arranged as a diode which is poled in the forward direction and is connected in series with the first resistor, the emitter of the second transistor is connected to the first junction point via at least one fourth transistor of the first conductivity type arranged as a diode and poled in the forward direction, and the series arrangement of a fifth resistor and a first semiconductor junction poled in the forward direction is arranged between the first and the third junction point.

By the addition of the first semiconductor junction and the fifth resistor and the inclusion of the third and the fourth transistor, which are arranged as diodes, in the first and the second series circuit respectively, a second compensation component is added to the generated current, so that when the various elements have been dimensioned correctly a temperature coefficient equal to zero is obtained over a wide temperature range. A preferred embodiment of the current stabilizing arrangement in accordance with the invention is characterized in that the differential amplifier comprises a sixth, seventh, eighth, ninth, tenth, eleventh, twelfth, thirteenth, fourteenth and fifteenth transistor of the first conductivity type, a sixteenth and a seventeenth transistor of a second conductivity type opposite to the first conductivity type, and a sixth and seventh resistor, the base connections of the sixth and the seventh transistor being connected to that terminal of the second resistor, which is remote from the second junction point, the base connections of the eighth and ninth transistor being connected to that terminal of the third resistor which is remote from the second junction point, the emitters of the sixth, seventh, eighth and ninth transistors being connected to the third junction point, the emitter areas of the sixth and ninth transistors being substantially greater than those of the seventh and eighth transistors, the collectors of the fifth, sixth and ninth transistors and the base connections of the tenth and eleventh transistors being connected to the second junction point, the collectors of the tenth and the eleventh transistors respectively being connected to the respective emitters of the twelfth and thirteenth transistors, the bases of the twelfth and thirteenth transistors being connected to the respective collectors of the sixteenth and the seventeenth transistors, the collectors of the twelfth and thirteenth transistors being connected to the respective emitters of the sixteenth and seventeenth transistors, the base and the collector of the seventeenth transistor being interconnected and being connected to the base of the sixteenth transistor, the emitters of the sixteenth and the seventeenth transistor being connected to a fourth junction point via the sixth and seventh resistor respectively, the base of the fourteenth transistor being connected to the emitter of the twelfth transistor, the base of the fifteenth transistor being connected to the emitter of the fourteenth transistor, the collectors of the fourteenth and fifteenth transistors being connected to the fourth junction point, the emitter of the fifteenth transistor being connected to the second junction point, and an eighth resistor being arranged between the second and the fourth junction point, which fourth junction point forms a power-supply terminal.

Owing to the double input transistors which constitute the input stage of the differential amplifier, current reduction may be applied to the pnp current mirror, so that leakage currents from these almost inevitable horizontal pnp transistors to the substrate are substantially reduced. Said leakage currents would have an adverse effect on the satisfactory operation of the current stabilizing arrangement. The invention will now be described in more detail with reference to the drawings, in which.

Figure 1:
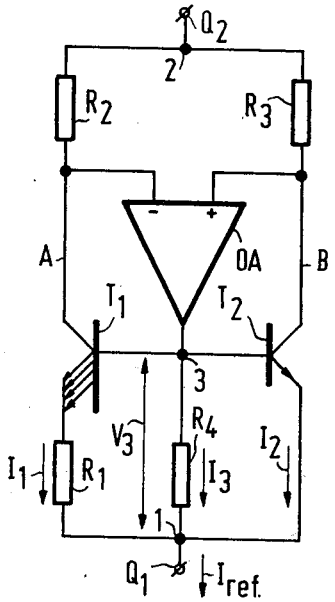
FIG. 1 is the circuit diagram of a known current stabilizing arrangement.

FIG. 1 shows the circuit diagram of a known current stabilizing arrangement. It comprises two series circuits A and B, which are arranged between the junction points 1 and 2. The series circuit A comprises the transistor $T_1$, whose emitter is connected to the junction point 1 via the resistor $R_1$ and whose collector is connected to the junction point 2 via the resistor $R_2$. The series circuit B comprises the transistor $T_2$, whose emitter is connected directly to the junction point 1 and whose collector is connected to the junction point 2 via the resistor R3. It is to be noted that the ratio between the emitter areas of the transistors $T_1$ and $T_2$ is equal to p (p>1), as is indicated in FIG. 1. The base of transistor $T_1$ and the base of transistor $T_2$ are connected to the junction point 3, which via the resistor $R_4$ is connected to the junction point 1. The inverting input (−) of the operational amplifier OA is connected to the collector of transistor $T_1$, whilst the non-inverting input (+) is connected to the collector of transistor $T_2$.

Furthermore, provisions have been made, in the form of the terminals $Q_1$ and $Q_2$, for the power supply of the circuit and for the take-off of the stabilized current. The operation of this current stabilizing arrangement is as follows:

Between terminals $Q_1$ and $Q_2$ a voltage of the correct polarity is applied, that is, $Q_2$ positive relative to $Q_1$. When it is assumed that the differential amplifier OA makes the junction point 3 positive relative to the junction point 1 a current will flow in the two series circuits. Since the differential amplifier has a very high gain only a very small, negligible voltage will be required across the inputs of the differential amplifier OA for biasing the junction point 3, so that it may be assumed that the collector voltage of transistor $T_1$ and the collector voltage of transistor $T_2$ are equal to each other. Consequently, the voltage drops across the resistors $R_2$ and $R_3$ will be equal to each other. If the last-mentioned resistors have equal values, the currents $I_1$ and $I_2$ in the series circuits A and B will be equal to each other and will be independent of the voltage applied to the terminals $Q_1$ and $Q_2$. The magnitude of the currents $I_1$ and $I_2$ will be determined by the value of the resistor $R_1$ and the emitter-area ratio p. The voltage $V_3$ across terminals 1 and 3 must comply with two relationships, namely:

$$V_3 = \frac{kT}{q} \ln \frac{I_1}{pI_o} + I_1R_1 \quad (1)$$

and $$V_3 = \frac{kT}{q} \ln \frac{I_2}{I_o} \quad (2)$$

where k is Boltzmann's constant, T the absolute temperature, q the electron charge, and $I_o$ the minority current of transistor $T_2$. It follows from (1) and (2), if $I_1=I_2$, that $$I_1R_1 = \frac{kT}{q} \ln p \quad (3)$$

In order to compensate for the temperature dependence of the sum of the currents $I_1+I_2$ a third component is added, which enables the temperature coefficient of the output current $I_{ref}=I_1+I_2+I_3$ to be made zero for one specific temperature. That it is possible can be demonstrated as follows:

From (3) it follows that the sum of the currents $I_1$ and $I_2$ depends on the temperature as a linear function. The temperature dependence of the compensation current $I_3$ may be expressed as follows:

$$\frac{\partial I_3}{\partial T} = \frac{\partial V_3}{\partial T} \cdot \frac{1}{R_4} \text{ or with} \quad (2)$$

$$\frac{\partial I_3}{\partial T} = \frac{1}{R_4} \frac{\partial}{\partial T}\left(\frac{kT}{q} \ln \frac{I_1}{I_0}\right) \quad (4)$$

If the expression $$I_o = CT^n \exp\left(\frac{-qVg}{kT}\right)$$

known from semiconductor physics is used, in which C is an individual constant, n is an empirical exponent and Vg is the gap voltage, (4) will become as follows after differentiation in the right-hand term:

$$\frac{I_3}{T} = \frac{I_1}{T} + \frac{kT}{qR_4}\left(\frac{1-n}{T} - \frac{qVg}{kT^2}\right) \quad (5)$$

The derivative with respect to the temperature of the total current $I_{ref}$ is:

$$\frac{\partial I_{ref}}{\partial T} = 2\frac{\partial I_1}{\partial T} + \frac{\partial I_3}{\partial T} = 2\frac{I_1}{T} + \frac{I_3}{T} + \frac{k}{qR_4}\left(1 - n - \frac{qVg}{kT}\right)$$

By a suitable choice of $R_4$ it is consequently possible to make $$\frac{\partial I_{ref}}{\partial T}$$

equal to zero for one specific temperature. However, the term (1−n) is the cause that attempts to make $$\frac{\partial I_{ref}}{\partial T}$$

zero over a wide temperature range using this method are likely to fail. It is the object of the invention to provide a circuit arrangement in which said compensation is possible over a wide temperature range.

Figure 2:
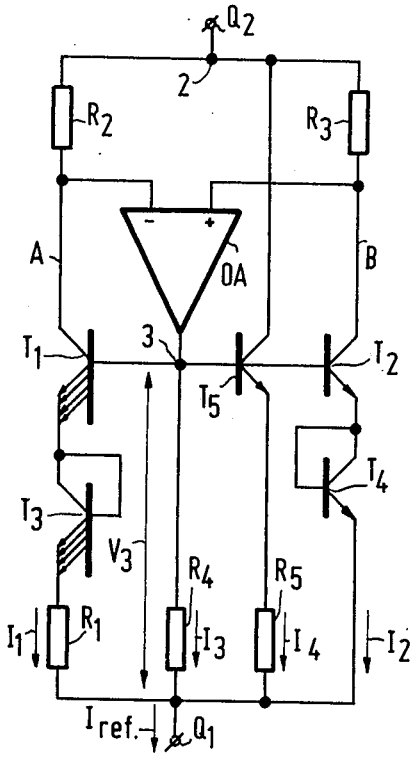
FIG. 2 is the circuit diagram of a current stabilizing arrangement in accordance with the invention.

FIG. 2 shows the circuit diagram of the current stabilizing arrangement in accordance with the invention, by means of which this can be achieved. In comparison with the known current stabilizing arrangement of FIG. 1 transistors $T_3$ and $T_4$, arranged as diodes, are included in the emitter circuits of transistors $T_1$ and $T_2$ respectively and an emitter-follower transistor $T_5$ is added, whose base is connected to the junction point 3 and whose emitter is connected to the junction point 1 via a fifth resistor $R_5$. The output current $I_{ref}$ of this arrangement comprises the sum of the components $I_1$, $I_2$, $I_3$ and $I_4$, so that the requirement is now that:

$$2\frac{\partial I_1}{\partial T}+\frac{\partial I_3}{\partial T}+\frac{\partial I_4}{\partial T}=0 \quad (6)$$

The relationship $$\frac{\partial I_1}{\partial T}=\frac{\partial I_2}{\partial T}$$

is still valid, but because two base-emitter junctions are arranged in the two series circuits A and B equation (5) should be replaced by $$\frac{\partial I_3}{\partial T}=\frac{I_3}{T}+\frac{2kT}{qR_4}\left(\frac{1-n}{T}-\frac{qVg}{kT^2}\right) \quad (7)$$

For the third component $I_4$ the following is valid:

$$I_4R_5=\frac{2kT}{q}\ln\frac{I_1}{I_o}-\frac{kT}{q}\ln\frac{I_4}{I_0},$$

which after differentiation yields:

$$\frac{\partial I_4}{\partial T}=\frac{I_4}{T}+\frac{2k}{qR_5}-\frac{kT}{qR_5}\left(\frac{n}{T}-\frac{qVg}{kT^2}\right)-\frac{kT}{q}\ \frac{1}{R_5I_4}\ \frac{I_4}{T},$$

from which it follows that:

$$\frac{\partial I_4}{\partial T}=\frac{\frac{I_4}{T}+\frac{2k}{qR_5}-\frac{kT}{qR_5}\left(\frac{n}{T}-\frac{qVg}{kT^2}\right)}{1+\frac{kT}{q}\cdot\frac{1}{R_5I_4}}$$

Since $(kT/q)\simeq 0.025$ and $R_5I_4$ is at least of the order of 0.7 V, the approximation may be used that the denominator of (8) is equal to 1, so that:

$$\frac{\partial I_4}{\partial T}=\frac{I_4}{T}+\frac{kT}{qR_5}\left(\frac{2-n}{T}-\frac{qVg}{kT^2}\right) \quad (9)$$

The following is valid for the total current $I_{ref}$:

$$\frac{\partial I_{ref}}{\partial T}=2\frac{\partial I_1}{\partial T}+\frac{\partial I_3}{\partial T}+\frac{\partial I_4}{\partial T}$$

which is combination with (7) and (9) yields:

$$\frac{\partial I_{ref}}{\partial T}=\frac{2I_1}{T}+\frac{I_3}{T}+\frac{2kT}{qR_4}\left(\frac{1-n}{T}-\frac{qVg}{kT^2}\right)+\frac{I_4}{T}+\frac{kT}{qR_5}\left(\frac{2-n}{T}-\frac{qVg}{kT^2}\right) \quad (10)$$

or:

$$\frac{\partial I_{ref}}{\partial T}=\frac{I_{ref}}{T}-\frac{Vg}{T}\left(\frac{2}{R_4}+\frac{1}{R_5}\right)+$$

-continued $$\frac{k}{q}\left\{\frac{2(1-n)}{R_4}+\frac{2-n}{R_5}\right\}$$

In order to comply with (6), it is required that $$\frac{\partial I_{ref}}{\partial T}=0$$

and in conformity with (10) this is possible only in the case of a variable T if:

$$\frac{2}{R_4}+\frac{1}{R_5}=\frac{I_{ref}}{V_9}\text{ and }\frac{2(1-n)}{R_4}+\frac{2-n}{R_5}=0$$

For a specific value of the current $I_{ref}$ this yields the values of the resistors $R_4$ and $R_5$. It is to be noted that it is alternatively possible to increase the number of diode junctions in the emitter lines of the transistors $T_1$, $T_2$ and $T_5$.

Figure 3:
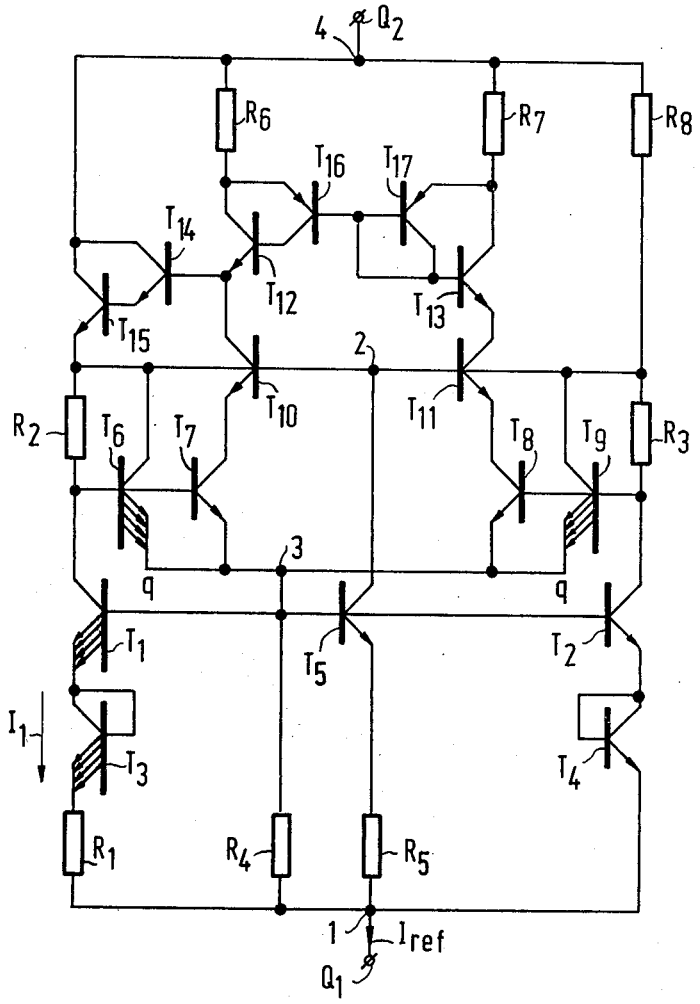
FIG. 3 is the circuit diagram of a preferred embodiment of the invention.

FIG. 3 shows the circuit diagram of a preferred embodiment of a current stabilizing arrangement in accordance with the invention. The part of the circuit arrangement comprising the transistors $T_1$ to $T_5$ and the resistors $R_1$ to $R_5$ is identical to the corresponding part of the circuit arrangement of FIG. 2 and requires no further explanation. The characteristic feature in the arrangement of FIG. 3 is the design of the differential amplifier, which comprises the transistors $T_6$ to $T_{17}$ and the resistors $R_6$ and $R_7$. Transistors $T_6$ to $T_9$ form an input differential stage, in which current reduction is obtained by selecting the emitter area of the transistors $T_6$ and $T_9$ so as to be a factor q larger than those of the transistors $T_7$ and $T_8$. The common base connection of the transistors $T_6$ and $T_7$ constitutes the inverting input of the differential amplifier and is connected to the collector of transistor $T_1$, the common base connection of transistors $T_8$ and $T_9$ constituting the non-inverting input of the differential amplifier. The impedance at junction point 3 serves as the common emitter resistor for the transistors $T_6$ to $T_9$. The two collector currents of the transistors $T_6$ and $T_9$ are both applied to junction point 2, so that they have no effect because they are in phase opposition.

Via the main current path of transistors $T_{10}$ and $T_{11}$ respectively the reduced collector currents of transistors $T_7$ and $T_8$ are applied to the emitters of transistors $T_{12}$ and $T_{13}$ respectively. The base connections of the transistors $T_{10}$ and $T_{11}$ are connected to junction point 2, so that the last-mentioned transistors receive a substantially constant collector-base voltage. Transistors $T_{12}$ and $T_{16}$ and the resistor $R_6$ constitute the collector load of transistor $T_{10}$. Via the resistor $R_6$ the collector of transistor $T_{12}$ and the emitter of transistor $T_{16}$ are connected to the junction point 4, which also serves as the power-supply terminal $Q_2$. The collector of transistor $T_{16}$ is connected to the base of transistor $T_{12}$. The base of transistor $T_{16}$ is connected to the base of transistor $T_{17}$, which is interconnected to the collector of transistor $T_{17}$ and the base of transistor $T_{13}$. The collector of transistor $T_{13}$ and the emitter of transistor $T_{17}$ are connected to the junction point 4 via resistor $R_7$. Transistors $T_{13}$ and $T_{17}$ and the resistor $R_7$ together constitute the collector load for transistor $T_{11}$. Since the collector currents of the transistors $T_7$, $T_8$ and $T_{10}$, $T_{11}$ respectively have already been reduced in the manner described, the pnp transistors $T_{16}$ and $T_{17}$ carry an extremely small current also as a result of the current gain factor of transistors $T_{12}$ and $T_{13}$. As is known, horizontal configurations are employed for pnp transistors in customary integration techniques, which configurations in the case of normal current passage exhibit parasitic leakage currents to the substrates. By minimizing the current passage through transistors $T_{16}$ and $R_{17}$ in the present circuit arrangement the leakage currents to the substrate can also be limited to an acceptable value. This is necessary because otherwise they would impair a satisfactory operation of the current circuit.

The operation of the transistors $T_{12}$ and $T_{16}$, which are arranged as a collector load, and the resistor $R_6$ may be explained as follows. Assuming that the base of transistor $T_{16}$ is maintained at a constant potential, for example, an increase of the collector current of transistor $T_{10}$ will give rise to an increased voltage drop across the resistor $R_6$. As a result of this, the base emitter voltage of transistor $T_{16}$ will decrease and said transistor will supply a smaller current to the base of transistor $T_{12}$. Consequently, a high impedance will be observed at the emitter of transistor $T_{12}$, which impedance can be further increased by connecting the base of transistor $T_{16}$ to the base and collector of transistor $T_{17}$ resulting in the base of transistor $T_{16}$ receiving a signal on its base which is in phase opposition to the signal which appears on its emitter via transistors $T_7$, $T_{10}$ and $T_{12}$, thereby adding to the effect just described. As a result, the dividing circuit comprising the transistors $T_{12}$, $T_{13}$, $T_{16}$ and $T_{17}$ and the resistors $R_6$ and $R_7$ may be regarded as a current mirror circuit, the current applied by transistor $T_{11}$ appearing "mirror-inverted" on the emitter of transistor $T_{12}$. The emitter of transistor $T_{12}$ is connected to the base of transistor $T_{14}$, which together with transistor $T_{15}$ constitutes a so-called Darlington arrangement. The emitter of transistor $T_{15}$ is connected to junction point 2, so that the output signal of the differential amplifier is available on this junction point. Said output signal is transferred to junction point 3 via the resistors $R_2$ and $R_3$ *and the input transistors T6* and $T_7$, which now operate as emitter-followers. The common emitter connection of the transistors $T_6$ and $T_9$ may therefore be regarded as the output of the differential amplifier, in conformity with the arrangement of FIG. 2.

For starting the current source circuit of FIG. 3 the starting resistor $R_8$ is arranged between junction points 4 and 2.

What is claimed is:

1. A current stabilizing arrangement comprising a first and a second series circuit (A and B respectively), which are each connected between a first and a second junction point (1 and 2 respectively), which first series circuit (A) comprises the main current path of a first transistor ($T_1$) of a first conductivity type, a first resistor ($R_1$), and a second resistor ($R_2$), and which second series circuit (B) comprises the main current path of a second transistor ($T_2$) of the first conductivity type, having an emitter area which is smaller than that of the first transistor ($T_1$), and a third resistor ($R_3$), suitably having a value equal to that of the second resistor ($R_2$), which first resistor ($R_1$) is arranged between the emitter of the first transistor ($T_1$) and the first junction point (1), which second resistor ($R_2$) is arranged between the collector of the first transistor ($T_1$) and the second junction point (2), and which third resistor ($R_3$) is arranged between the collector of the second transistor ($T_2$) and the second junction point (2), the base connections of the first and the second transistor ($T_1$ and $T_2$ respectively) being connected to a third junction point (3), a fourth resistor ($R_4$) being arranged between the third junction point (3) and the first junction point (1), there being provided a differential amplifier (OA) having an inverting input (−), a non-inverting input (+), and an output, which inverting input (−) is connected to that terminal of the second resistor ($R_2$) which is remote from the second junction point (2), which non-inverting input (+) is connected to that terminal of the third resistor ($R_3$) which is remote from the second junction point, and which output is coupled to the third junction point (3), the current stabilizing arrangement comprising means ($Q_1$, $Q_2$) for applying a power-supply voltage thereto for maintaining a potential difference between the first and the second junction point (1 and 2 respectively) and for taking off a stabilized current from one of said points, characterized in that between the emitter of the first transistor ($T_1$) and the first junction point (1) there is arranged at least one third transistor ($T_3$) of the first conductivity type, arranged as a diode which is poled in the forward direction and is connected in series with the first resistor $R_1$, the emitter of the second transistor ($T_2$) is connected to the first junction point (1) via at least one fourth transistor ($T_4$) of the first conductivity type arranged as a diode and poled in the forward direction, and the series arrangement of a fifth resistor ($R_5$) and a first semiconductor junction is arranged between the first and the third junction point (3).

2. A current stabilizing arrangement as claimed in claim 1, characterized in that the first semiconductor junction comprises the base-emitter junction of a fifth transistor ($T_5$), whose base is connected to the third junction point (3) and whose collector is connected to the second junction point (2).

3. A current stabilizing arrangement as claimed in claim 1 or 2, characterized in that the differential amplifier comprises a sixth, seventh, eighth, ninth, tenth, eleventh, twelfth, thirteenth, fourteenth and fifteenth transistor ($T_6$ to $T_{15}$) of the first conductivity type, a sixteenth and a seventeenth transistor ($T_{16}$, $T_{17}$) of a second conductivity type opposite to the first conductivity type, and a sixth and seventh resistor ($R_6$, $R_7$), the base connections of the sixth and the seventh transistor ($T_6$ and $T_7$ respectively) being connected to that terminal of the second resistor ($R_2$) which is remote from the second junction point (2), the base connections of the eighth and ninth transistor ($T_8$ and $T_9$ respectively) being connected to that terminal of the third resistor ($R_3$) which is remote from the second junction point (2), the emitters of the sixth, seventh, eighth, and ninth transistors ($T_6$, $T_7$, $T_8$, $T_9$) being connected to the third junction point (3), the emitter areas of the sixth and ninth transistors ($T_6$, $T_9$) being substantially greater than those of the seventh and eighth transistors ($T_7$, $T_8$), the collectors of the fifth, sixth and ninth transistors ($T_5$, $T_6$, $T_9$) and the base connections of the tenth and eleventh transistors ($T_{10}$, $T_{11}$) being connected to the second junction point (2), the collectors and the tenth and eleventh transistors ($T_{10}$ and $T_{11}$ respectively) being connected to the respective emitters of the twelfth and thirteenth transistors ($T_{12}$ and $T_{13}$ respectively), the bases of the twelfth and thirteenth transistors $T_{12}$ and $T_{13}$ respectively) being connected to the respective collectors of the sixteenth and the seventeenth transistors ($T_{16}$ and $T_{17}$ respectively), the collectors of the twelfth and thirteenth transistors ($T_{12}$ and $T_{13}$ respectively) being connected to the respective emitters of the sixteenth and the seventeenth transistors ($T_{16}$ and $T_{17}$ respectively), the base and the collector of the seventeenth transistor ($T_{17}$) being connected to the base of the sixteenth transistor ($T_{16}$), the emitters of the sixteenth and the seventeenth transistor ($T_{16}$ and $T_{17}$ respectively) being connected to a fourth junction point (4) via the sixth and seventh resistor respectively ($R_6$ and $R_7$ respectively), the base of the fourteenth transistor ($T_{14}$) being connected to the emitter of the twelfth transistor ($T_{12}$), the base of the fifteenth transistor ($T_{15}$) being connected to the emitter of the fourteenth transistor ($T_{14}$), the collectors of the fourteenth and fifteenth transistors ($T_{14}$, $T_{15}$) being connected to the fourth junction point (4), the emitter of the fifteenth transistor ($T_{15}$) being connected to the second junction point (2), and an eighth resistor ($R_8$) being arranged between the second and the fourth junction point (2, 4), which fourth junction point (4), forms a power-supply terminal ($Q_2$).

* * * * *

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

In the Abstract line 1, change "In a" to --A--
line 3, delete " steps are"
line 4, change "taken, in accordance with the invention," to --has been improved--

Column 1, line 54, change "AD" to --A/D--

Column 2, line 66, delete "and"

Column 3, line 20, change "whilst" to --while--
line 23, delete "power"; after "supply of" insert --power to--

Column 4, line 46, change "cause" to --reason--
line 53, change "is the" to --is an--
line 62, change "," (comma) to --.-- (period)
line 63, change "whose base" to --The base of T5--
line 64, change "whose" to --its--

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

Column 5, line 29, change "$\frac{I_4}{T}$" (last occurrence) to

-- $\frac{\rangle I_4}{\rangle T}$ --

Column 5, line 36, after the equation insert --(8)--
line 56, after the equation delete "(10)"

Column 6, line 3, after the equation insert --(10)--
line 33, delete "," (comma)
line 52, delete "," (comma)

Column 7, lines 33 and 39, change "on" to --at--

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

Claim 1, Lines 2-3 delete "(A and B respectively), which are"
line 4, delete "(1 and 2 respectively), which"
and insert --, said--
line 5, change "comprises" to --comprising--
line 7, delete "and which" and insert
--said--
line 8, change "comprises" to --comprising a
third resistor and--
line 9, delete "," (comma) and insert --and--
line 11, delete "and a" and insert --the--;
delete ", suitably"
line 12, delete "($R_2$)"

line 13, delete "which" and insert --, said--
line 13, delete "($R_1$) is arranged" and
insert --being coupled--
line 14, delete "($T_1$)"
line 15, change "which" to --said--
line 15, delete "($R_2$) is arranged" and insert
--being coupled--

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

Claim 1, line 16, delete "($T_1$)"
line 17, change "and which" to --the--
line 17, delete "(R3) is arranged" and insert --being coupled--
line 18, delete "($T_2$)"
line 19, delete "(2)"
line 20, delete "($T_1$ and $T_2$ respec-"
line 21, delete "tively)"
line 22, delete "being arranged" and insert --coupled--
line 23, delete "(3)"; delete "(1), there"
line 24, delete "being provided" and insert --,-- (comma)
line 26, delete "which" and insert --means connecting the--; delete "is connected"
line 27, delete "($R_2$)"
line 28, delete "(2), which" and insert --,means connecting the--
line 29, delete "is connected"

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

Claim 1, line 30, delete "($R_3$)"
line 31, delete "and which" and insert --means coupling the amplifier--
line 31, delete "is coupled"
line 32, delete "(3), the current stabilizing arrangement compris"
line 33, delete "ing"
line 33, before "means" insert --,-- (comma); delete "(Q1,Q2)for applying a power-supply voltage"
line 34, delete "thereto"
line 35, delete "(1 and 2 respec-"
line 36, delete "tively)"
line 37, after "said" insert --junction--
line 38, delete "($T_1$)" and "(1)"
line 39, change "arranged" to --coupled--
line 40, change ", arranged" to --and connected--
line 41, delete "is"
line 42, delete "$R_1$"; after "," insert --means connecting--
line 43, delete "($T_2$) is connected"; delete "(1)"
line 45, change "arranged" to --and connected--
line 47, change "is arranged" to --coupled--
line 48, delete "(3)"

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

Claim 2, line 2, change "characterized in that" to --wherein--
line 4, change ", whose" to --having a--; delete "is"
line 5, delete "(3)"; change "whose" to --a--; delete "is"
line 6, delete "(2)"

Claim 3, line 2, change "claim" to --claims--
line 9, after "sixth" insert --($T_6$)--: after "seventh" insert --($T_7$)--
line 10, delete "(T6 and T7 respectively)"
line 11, delete "(R2)"
line 13, after "eighth" insert --(T8)--; after "ninth" insert --(T9)--; delete "($T_8$ and $T_9$ respectively)"
line 15, delete "(R3)" and "(2)"
line 17, delete "($T_6$,$T_7$,$T_8$,$T_9$)"
line 24, change "and the" to --of the--
line 25, delete "($T_{10}$ and $T_{11}$ respectively)"
line 26, after "twelfth" insert --($T_{12}$)--
line 27, after "thirteenth" insert --($T_{13}$)--; delete "($T_{12}$ and $T_{13}$ respectively)"

UNITED STATES PATENT AND TRADEMARK OFFICE

CERTIFICATE OF CORRECTION

PATENT NO. : 4,446,419

DATED : May 1, 1984

INVENTOR(S) : RUDY J. VAN DE PLASSCHE ET AL

It is certified that error appears in the above-identified patent and that said Letters Patent is hereby corrected as shown below:

Claim 3, line 28, delete "$T_{12}$ and"
line 29, delete "$T_{13}$ respectively)"
line 30, after "sixteenth" insert --($T_{16}$)--;
after "seventeenth" insert --($T_{17}$)--
line 31, delete "($T_{16}$ and $T_{17}$ respectively)"
line 32, delete "($T_{12}$ and $T_{13}$ respec-"
line 33, delete "tively)"
line 34, delete "($T_{16}$ and $T_{17}$ "
line 35, delete "respectively)"
line 38, delete "($T_{16}$ and $T_{17}$ re-"
line 39, delete "spectively)"
line 40, delete "($R_6$"
line 41, delete "and $R_7$ respectively)"
line 46, delete "($T_{14}$, $T_{15}$)"
line 47, delete "(4)"
line 48, delete "($T_{15}$)" and "(2)"
line 49, change "being arranged" to --coupled--
line 50, delete "(2, 4), which" and insert
--, said--

UNITED STATES PATENT AND TRADEMARK OFFICE

CERTIFICATE OF CORRECTION

PATENT NO. : 4,446,419

DATED : May 1, 1984

INVENTOR(S) : RUBY J. VAN DE PLASSCHE ET AL

It is certified that error appears in the above-identified patent and that said Letters Patent is hereby corrected as shown below:

Claim 3, line 51, delete "(4), forms" and insert
-- forming--
line 52, delete "($Q_2$)" and insert -- of the current stablizing arrangement--

Signed and Sealed this

*Fifteenth* Day of *October 1985*

[SEAL]

*Attest:*

*Attesting Officer*

DONALD J. QUIGG

*Commissioner of Patents and Trademarks—Designate*